United States Patent [19]

Cangelosi

[11] Patent Number: 4,491,902

[45] Date of Patent: Jan. 1, 1985

[54] COMBINATION MOUNTING BRACKET AND LIGHT SOCKET

[76] Inventor: Frank V. Cangelosi, 10102 Briley Way, Villa Park, Calif. 92667

[21] Appl. No.: 483,578

[22] Filed: Apr. 11, 1983

Related U.S. Application Data

[63] Continuation-in-part of Ser. No. 414,887, Sep. 3, 1982.

[51] Int. Cl.[3] ..... F21V 21/06

[52] U.S. Cl. ..... 362/389; 362/396; 362/430; 362/299; 248/231.2; 248/231.4; 248/309.1

[58] Field of Search ..... 362/389, 396, 430, 249; 248/226.1, 226.3, 226.5

[56] References Cited

U.S. PATENT DOCUMENTS 2,889,451 6/1959 Longo ..... 362/396

4,219,870 8/1980 Haraden et al. ..... 362/396

*Primary Examiner*—Stephen J. Lechert, Jr.

*Attorney, Agent, or Firm*—Francis X. LoJacono

[57] ABSTRACT

An improved device for hanging a strand of ornamental light fixtures, wherein the device includes a mounting bracket having a bottom wall and a pair of oppositely positioned flexible side-clamping walls, so as to clamp the bracket to a fixed structure. The bottom wall includes a channel formed therein to slidably receive a head member formed on the light socket, whereby the light socket is removably attached to the mounting bracket.

A second embodiment is formed having a pair of adjustable interconnecting wall sections, one section having a side-clamping wall and an integrally formed support wall, the other wall section having a side-clamping wall and an integrally formed bottom wall which includes a channel. The engaging surfaces of the support wall and the bottom wall include a plurality of projecting teeth members for adjusting the bracket to fit a particular size fixed structure.

14 Claims, 7 Drawing Figures

COMBINATION MOUNTING BRACKET AND LIGHT SOCKET

CROSS-REFERENCE

This application is a continuation-in-part of application Ser. No. 414,887 filed Sept. 3, 1982 by the applicant, Frank V. Cangelosi, and bearing the same title as the present application.

BACKGROUND OF THE INVENTION

1. Field of the Invention

The invention relates generally to electric-light fixtures, and more particularly to an improved means for hanging electric-light fixtures adapted to removably support light-bulb sockets of the type used outdoors.

2. Description of the Prior Art

It is well known in the art that various problems and difficulties are being encountered in providing suitable means for hanging and/or supporting light-bulb sockets of the type generally used for ornamental-lighting lamps located outdoors. There are several problems especially in locating and hanging outdoor ornamental lamp devices which are spaced along a strand of electrical wiring, such as those employed for Christmas decoration.

Outdoor light fixtures are very often hung along the various roof projections or overhanging edges of houses or buildings. It is a common practice to staple the supporting strands or wires to the framework structure of a building. Various other types of devices have been improvised for mounting strands of electric-light wiring.

However, such devices have not been found to be very satisfactory for continuous year-round use. Further, such devices tend to cause damage to building structures as the lights are repeatedly remounted and hung. Known mounting devices such as metal staples or other fastener means are generally not compatible with light sockets or wiring used therewith, since short-circuiting of the electrical system is always a real danger. Also, the use of such mounting devices is very time-consuming, and it can be very inconvenient and uncomfortable when one is decorating the outside of a building during adverse weather conditions.

There are other types of mounting devices which are sometimes employed for ornamental strand-type light fixtures. These devices include rigid support members that must be secured to the building structure—and these devices not only tend to disfigure the building, but create the additional problem of storage after their use.

As other examples of known devices in the art relating to the mounting of continuous strands of ornamental light fixtures, the following listed U.S. patents are worth noting.

U.S. Pat. No. 990,856 discloses an electric-lamp holder comprising a pair of integrally united jaws formed by suitably bending a flat blank member, whereby two jaws are oppositely disposed from each other so as to grip a structure, such as furniture. A tongue member projects outwardly from the heel of each jaw member, and is adapted to receive and support a lamp socket.

U.S. Pat. No. 2,782,296 discloses a clamp specifically designed for clamping a Christmas-tree light socket to a branch of the tree. This device includes a light socket adapted to receive and retain a manually operable clamp having serrated faces engageable with a branch of a tree.

Another mounting device for ornamental lamp fixtures is disclosed in U.S. Pat. No. 2,889,451 wherein the mounting device is shown as an essentially cylindrical socket having, at opposite sides thereof, elongated grooves terminating in lateral bayonet offsets for receiving the wire strand of the lighting system as each light socket is inserted into a cylindrical socket of the mounting device. The lower extremity of the cylindrical socket is provided with a beaded edge having a snap engagement with the beaded edge on an interconnectable flat mounting part, the mounting part being adapted to be secured to a structure in a permanent manner by a screw or nail.

U.S. Pat. No. 3,321,730 also discloses a mounting fixture for a strand-type ornamental lighting system which comprises a light socket having a pair of oppositely disposed mounting arms integrally formed as part of the light socket, so as to grasp the branch of a tree.

A hanger for outdoor light sockets is also disclosed in U.S. Pat. No. 3,578,282, this device being particuarly designed for mounting a light socket to an eavestrough or gutter. The hanger comprises a hooked member adapted to be attached to the upper outer edge of an eavestrough. The light socket is formed having a clip member which is removably mounted to an aperture formed in the hook member.

A flexible hanger or electric-light sockets is disclosed in U.S. Pat. No. 3,584,795 which comprises a flexible hanger adapted to be mounted along a house eavestrough. The hanger is formed having an upstanding and generally vertical edge flange, a horizontal web, and a second generally vertical flange member depending from the web. The flexible hanger includes two arms which partially surround and resiliently clasp an electric-light socket.

SUMMARY AND OBJECTS OF THE INVENTION

The present invention has for an important object to overcome the existing problems and to provide a novel support bracket adapted to be used with a single light socket, or more specifically with a strand of continuous light fixtures—generally of the ornamental type—which are hung along the eaves or overhanging structure of a building, particularly when decorating for the Christmas season.

Another object of the invention is to provide a light socket in combination with a simple clamp-type bracket, whereby the socket and bracket can be removably secured to each other, and the bracket can be mounted to the eaves of a building by the resilient clamping action of the substantially "U"-shaped bracket. The bracket is designed to be force-fitted over the lower exposed edge of the eaves, which are generally formed from a wood plank approximately two inches thick.

Still another object of the invention is to provide a clamping bracket that includes a mounting receptacle adapted to removably receive a mounting-head member formed as part of the light socket.

It is still another object of the invention to provide a light-socket mounting device in combination with a light socket, wherein the socket-mounting device does not require additional fastening means, nor does it require any tools to attach it to the edge of the overhanging eaves of a building. The mounting device is so arranged as to include two flexible side-wall members adapted to grip the sides of a two-inch thick board normally defining the eaves of a building.

A further object of the invention is to provide a device of this character that has no moving parts, is easy to maintain, and is adapted for reuse on a continuous basis.

Still a further object of the invention is to provide a device of this character that is relatively inexpensive to manufacture, and is simple and rugged in construction.

A still further object of the invention is to provide an alternative arrangement of a light-socket-mounting device having a clamp-type bracket which is formed in two parts, wherein one part is adjustably interconnected to the other part so as to establish a clamping mode. This arrangement allows the bracket to be secured to eaves members having various sizes or thicknesses.

Still another object of the invention is to provide an adjustable mounting bracket that includes a mounting receptacle in one of the two bracket members, a socket-mounting member being adapted to be received and supported therein whereby the light socket is adapted to be mounted in the socket-mounting member.

Yet another object of the invention is to provide an adjustable mounting bracket that includes interlocking teeth members formed on opposing surfaces of each bracket member, so as to lock the clamp in a set position for the particular size eaves.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
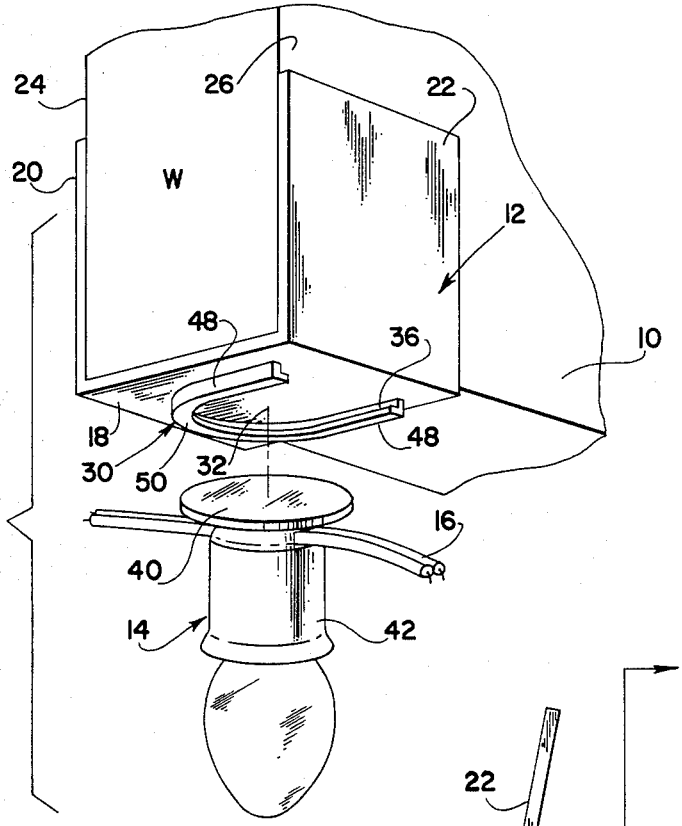
FIG. 1 is an exploded perspective view showing the mounting bracket secured to a fixed structure representing the eaves of a building and the compatible light socket prior to being installed in the "U"-shaped receptacle.

Referring more particularly to FIG. 1, there is shown a plank or board 10, which represents the overhanging roof structure or eaves of a building. It is well known that such planks are generally between an inch and three-quarters to two inches wide, as indicated at W.

Attached to plank 10 is the mounting bracket portion of the present invention, which is generally indicated at 12. Mounting bracket 12 is preferably formed from a suitable strong plastic material that includes a resilient characteristic so as to allow for mounting on various thickness of planks or boards 10.

Accordingly, the present invention is best suited for use with the strand-type ornamental lighting system which includes a plurality of light sockets, generally indicated at 14, strung together by an electrical cord 16.

Thus, a plurality of mounting brackets are selectively attached and spaced along the longitudinal edge of the depending plank so as to support each individual light socket 14 thereon in a very simple manner. That is, mounting bracket 12 comprises a substantially "U"-shaped body member defined by a flat lower support wall member 18 integrally provided with oppositely positioned side-clamping wall members 20 and 22.

Figure 2:
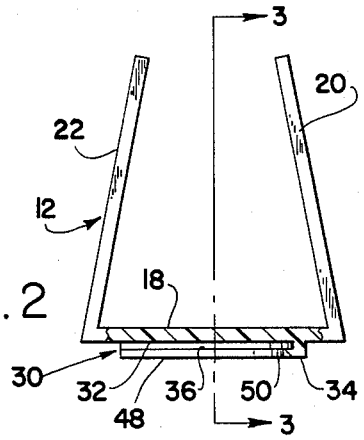
FIG. 2 is an end-elevational view thereof with the lower portion thereof in section.
Figure 3:
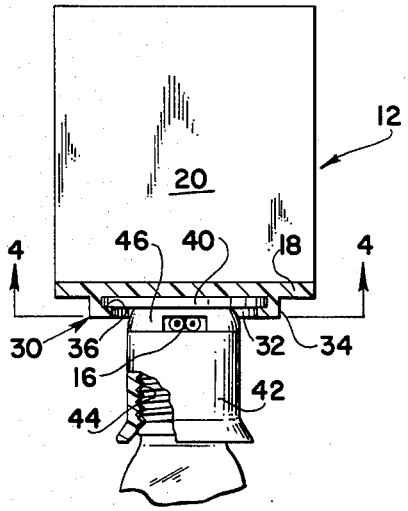
FIG. 3 is a vertical cross-seciton of the device taken substantially along line 3—3 of FIG. 2, and including the light socket mounted thereto.
Figure 4:
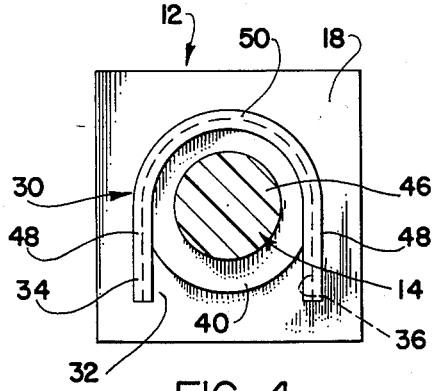
FIG. 4 is a cross-sectional view taken along line 4—4 in the direction of the arrows to better illustrate how the head portion of the light socket is positioned within the mounting receptacle.

The three wall sections 18, 20 and 22 are preferably formed having the same thickness, although the thickness of bottom wall 18 can vary is necessary. However, it is essential that the side-clamping walls are formed in an inwardly inclined manner so as to be converging, as illustrated in FIG. 2. This provides an inherent inwardly biasing action, whereby the side walls 20 and 22 will grip the opposing corresponding sides 24 and 26 of plank 10. Hence, it can be readily seen that one merely spreads the opposing walls 20 and 22 in an open manner, and then positions the bracket over the plank edge as seen in FIG. 1.

In order to removably mount each socket 14 to each bracket 12, a removable supporting means is provided which is formed as part of the bracket and as part of the light socket. More particularly, the removable supporting means comprises a receptacle member, generally indicated at 30, which is formed as an integral part of the bottom-wall member 18 in a somewhat "C"-shaped channel 32 defined by rail 34. Rail 34 is formed with a continuous groove 36. Thus, the "C"-shaped configuration or rail 34 provides an open end so as to receive the head member 40 which forms the second part of the removable supporting means.

Each socket is formed having a typical socket body 42 in which is provided a suitable threaded light-bulb connector 44 which is electrically connected to light cord 16 in any well known manner. Head 40 is thus provided at the closed socket end 46 and is preferably circular in configuration, having a thickness equal to or slightly less than the groove 36 defined by rail 34. Therefore, the "C"-shaped channel is readily adapted to receive the circular head 40, whereby head 40 slides in groove 34 and is firmly supported by the side portions 48 and the rear arcuate portion 50 of the receptacle 30.

If one so desires, once each bracket 12 is positioned in its proper location, it may be secured in place by a nail or the like.

However, in any case, the light sockets can easily be removed from their receptacles when the lighting system is to be stored for the next occasion. The mounting bracket can be left in place or also removed for storage at one's discretion.

The simplicity of the present invention reduces the time required for installation and removal after use, and it also prevents damage to the building structure, so that storage of both the wire strands and brackets would most likely be preferred because it can be so easily and quickly done.

ALTERNATIVE EMBODIMENT

Figure 5:
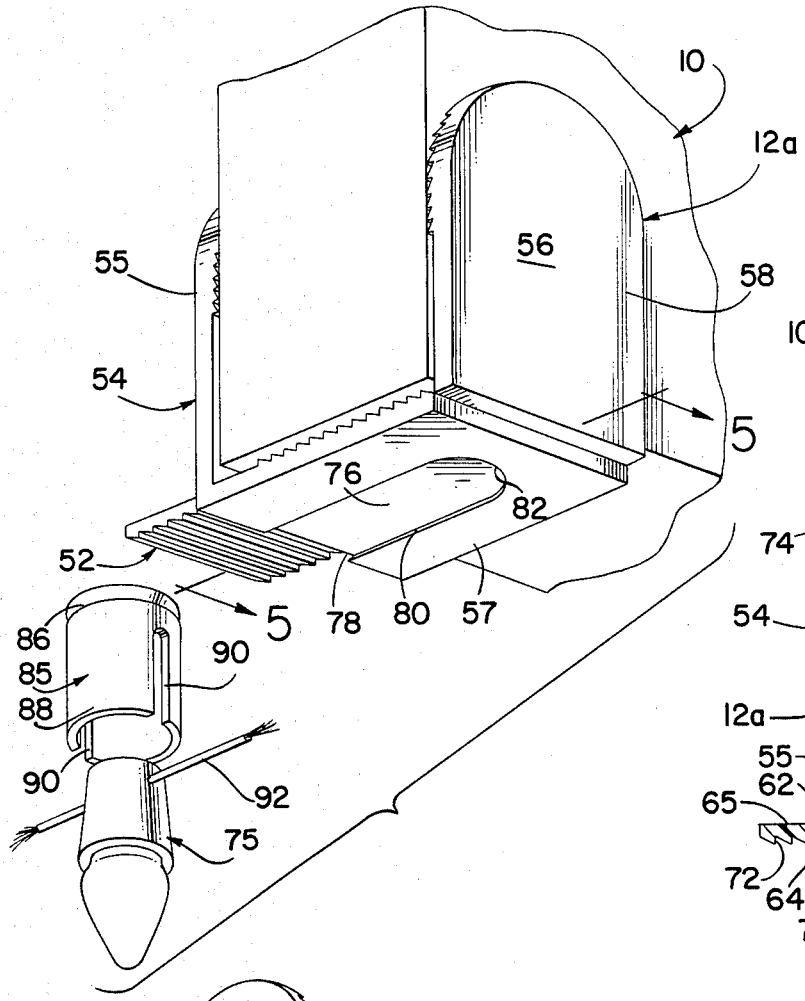
FIG. 5 is a partial exploded perspective view showing an alternative embodiment of the present invention wherein the clamping bracket is formed in two parts and includes a light-socket mounting member.
Figure 6:
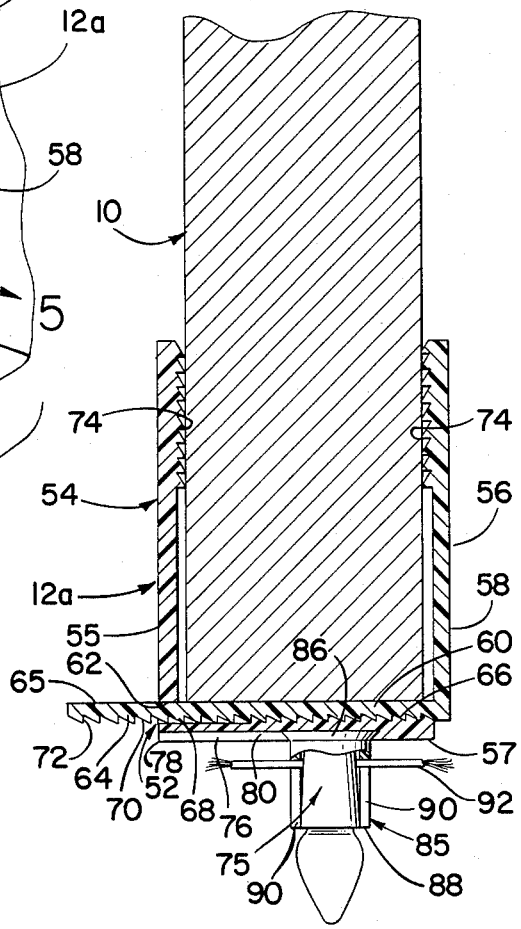
FIG. 6 is a cross-sectional view of the alternative embodiment taken substantially along line 5—5 of FIG. 5.
Figure 7:
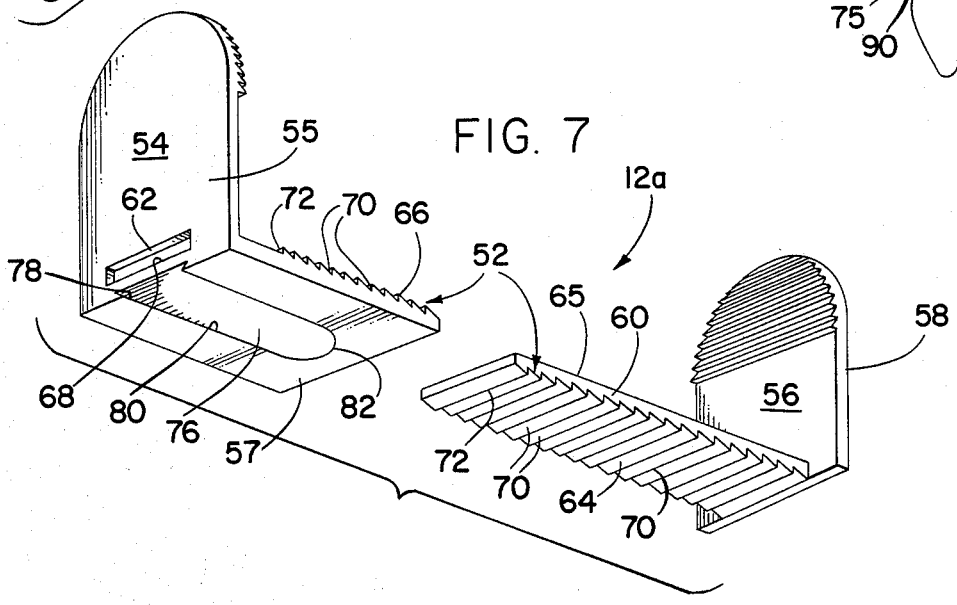
FIG. 7 is a perspective view of the mounting bracket with each member thereof being separated prior to assemblage.

Referring now to the alternative embodiment as illustrated in FIGS. 5 through 7, there is shown a plank 10 which represents, as previously mentioned herein, a fixed building structure such as an overhanging eaves member. However, in some applications the structure on which a string of lights 14 is to be hung will vary in thickness and type of material, so that the mounting bracket 12*a* might be required to include a means for adjusting the space between the clamping walls.

Accordingly, mounting bracket 12*a* is formed to include an adjusting means, generally indicated at 52; and thus the embodiment of the mounting bracket comprises a first wall section 54 and a second wall section 56 that form a substantially "U"-shaped body when interconnected. The first wall section 54 is formed having a perpendicular side-clamping wall member 55 and an integrally formed lower support wall 57, the second wall section 56 being formed having a perpendicular side-clamping wall member 58. Wall member 58 includes an integrally formed, substantially flat, bottom wall member 60. Thus, each wall section (54 and 56) has a somewhat "L"-shaped configuration.

The adjusting means 52 allows for the interconnection of each wall section so as to form the "U"-shaped clamp, and further allows the distance between the opposing clamping wall members 55 and 58 to be adjusted to accommodate a given thickness or width of the plank 10. The adjusting means 52 comprises a horizontal slot 62 at the base of clamping wall member 55 just above lower support wall 57 at the junction therewith. Slot 62 is adapted to receive the bottom wall member 60 of the second wall section 56, this bottom wall member being formed having a plurality of teeth 64 disposed transversely along the length thereof, as seen in FIGS. 7 and 8. Teeth 64 are formed on the lower surface, the upper surface 65 being substantially flat so as to readily pass through slot 62.

The upper surface of support wall 60 is also provided with transversely disposed teeth 66 and are located on approximately the front end thereof. Thus, teeth 64 and 66 will lockingly engage each other when the two wall sections are interconnected. In order to establish a more positive locking arrangement between the two sections 54 and 56, the bottom of slot 62 is formed having a single transverse tooth 68. Since each section is made from a suitable plastic material, wall 60 can be forced into and through slot 62, thus allowing teeth 64 of bottom wall 60 to snap over tooth 68 of slot 62. To aid in this locking arrangement of the adjusting means, each tooth is formed having a cam-inclined surface 70 and a vertical flat locking face 72.

In order to attach the bracket to a structure such as at 10, the two opposing wall sections are interconnected to each other just enough to hold them together; and then they are placed over the edge of structure 10 which is positioned between the vertical clamping walls 54 and 56, whereupon they are then squeezed together until each wall 54 and 56 clamps the opposing surfaces of the structure 10. To provide a gripping means to prevent the bracket from being readily pulled loose from the structure, a plurality of wedge-like teeth 74 are formed across the width of the upper free ends of the clamping side walls 54 and 56.

In order to provide a means for removably mounting a typical light socket 75, a longitudinal channel 76 defining a receptacle is formed in the bottom surface of support-wall member 57. One end of channel 76 is opened at 78, and a dovetail groove 80 is formed about the peripheral edge of the channel. The opposite end of channel 76 is closed; thus, channel 76 is adapted to receive and support a removable socket-mounting member 85. Member 85 is formed having a circular head 86 which is shaped to match the dovetail groove 80 so as to be removably secured in receptacle 76, as seen in FIG. 6. The annular socket body 88 of member 85 includes oppositely positioned vertical slots 90. These slots allow the lateral extending wire 92 to be positioned therein when light socket 75 is force-fitted in the socket-mounting member 85.

The embodiment as disclosed in FIGS. 5 through 7 having the removable socket-mounting member 85 provides a means by which most well known strand-type ornamental lighting systems can be readily employed therewith, whereby new specially designed light sockets are not required as in the first embodiment.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. An improved mounting bracket adapted to be mounted to a fixed structure member for hanging and removably supporting a light socket in combination, comprising:

a mounting bracket having a substantially "U"-shaped body defined by at least one bottom wall and oppositely disposed, flexible side walls, whereby said flexible side walls are adapted to engage the fixed structure member so as to be mounted thereon;

a light-socket mounting member adapted to be removably mounted to said mounting bracket, and including an extended head member formed on said light-socket-mounting member; and means for removably mounting said light socket to said mounting bracket, said means being a channel formed in said bottom wall of said mounting bracket, said channel having an open end to receive said head member and a closed end to aid in supporting said head member in said channel.

2. The combination as recited in claim 1, wherein said channel is defined by a "C"-shaped rail member.

3. The combination as recited in claim 2, wherein said "C"-shaped rail member is formed having two opposing side members and an integrally formed arcuate member defining the closed end thereof, wherein a groove is formed in said rail member, and wherein said head member is slidably recieved in said groove of said rail, so as to rest within said side and arcuate members when mounted to said bracket.

4. The combination as recited in claim 3, wherein said head member of said light socket is formed having a circular configuration, so as to conform to said configuration of said "C"-shaped rail member.

5. The combination as recited in claim 4, wherein said side walls of said mounting bracket are inclined inwardly in a converging manner, said walls providing an inwardly clamping action therebetween, whereby said bracket is clamped to a fixed structure.

6. The combination as recited in claim 5, wherein said mounting bracket is formed from a firm yet flexible plastic material.

7. The combination as recited in claim 1, wherein said "U"-shaped bracket comprises:

a first wall section; and a second wall section;

said wall sections being adapted to slidably attach to each other in and to an adjustable position; and means formed on said wall sections for adjustably positioning said wall sections to accommodate for the size of the structure on which they are mounted.

8. The combination as recited in claim 7, wherein said first wall section is formed having a perpendicular side-clamping wall member and an integrally formed lower support wall; and wherein said second wall section is formed having a perpendicular side-clamping wall member, and said integrally forrmed bottom wall includes said channel therein.

9. The combination as recited in claim 8, wherein said side-clamping wall member of said first wall section includes a horizontal slot therein to slidably receive said bottom wall of said second wall section.

10. The combination as recited in claim 9, wherein said adjusting means comprises a plurality of projections formed on each of said wall sections, so as to engage and lock said sections in a predetermined position.

11. The combination as recited in claim 10, wherein said projections are teeth members formed on the opposing surfaces between said lower support wall and said bottom wall.

12. The combination as recited in claim 11, wherein said side-clamping walls include gripping means to engage the sides of said structure, to aid in the clamping of said bracket thereon.

13. The combination as recited in claim 12, wherein said gripping means comprises a plurality of inwardly projecting teeth members.

14. The combination as recited in claim 9, wherein said light-socket-mounting member includes oppositely disposed slots, wherein a light socket is mounted in said mounting member and the wires of said light socket are received therein.

* * * * *